US011478406B1

(12) United States Patent
Rutter et al.

(10) Patent No.: US 11,478,406 B1
(45) Date of Patent: Oct. 25, 2022

(54) ASEPTIC FILLING APPARATUS AND METHOD

(71) Applicants: Chris C. Rutter, Redding, CA (US); Timothy E. Orr, Redding, CA (US)

(72) Inventors: Chris C. Rutter, Redding, CA (US); Timothy E. Orr, Redding, CA (US)

( * ) Notice: Subject to any disclaimer, the term of this patent is extended or adjusted under 35 U.S.C. 154(b) by 450 days.

(21) Appl. No.: 16/564,920

(22) Filed: Sep. 9, 2019

(51) Int. Cl.
*A61J 1/20* (2006.01)
*A61J 1/14* (2006.01)
*A61J 1/10* (2006.01)

(52) U.S. Cl.
CPC ..... *A61J 1/2048* (2015.05); *A61J 1/1406* (2013.01); *A61J 1/1443* (2013.01); *A61J 1/1475* (2013.01); *A61J 1/201* (2015.05); *A61J 1/10* (2013.01); *A61J 1/2024* (2015.05); *A61J 1/2027* (2015.05)

(58) Field of Classification Search
CPC ..... A61J 1/2048; A61J 1/1406; A61J 1/1443; A61J 1/1475; A61J 1/201; A61J 1/10; A61J 1/2024; A61J 1/2027; A61J 1/14; A61J 1/20
See application file for complete search history.

(56) References Cited

U.S. PATENT DOCUMENTS 4,386,933 A * 6/1983 Sanchez ..... A61M 39/14 604/905
5,334,188 A * 8/1994 Inoue ..... A61M 39/14 604/905
6,582,415 B1 * 6/2003 Fowles ..... A61J 1/2089 137/614.04
6,875,203 B1 * 4/2005 Fowles ..... A61J 1/2089 604/414
7,329,250 B2 * 2/2008 Romano ..... A61M 1/0001 604/317
7,867,215 B2 * 1/2011 Åkerlund ..... A61J 1/2089 604/413
8,123,738 B2 * 2/2012 Vaillancourt ..... A61M 39/26 604/533
8,777,921 B2 * 7/2014 Kashmirian ..... A61M 39/18 604/406
9,254,361 B2 * 2/2016 Rahimy ..... A61M 5/1411
9,597,260 B2 * 3/2017 Ivosevic ..... A61J 1/201
9,642,775 B2 * 5/2017 Sanders ..... A61J 1/2072
9,895,288 B2 * 2/2018 Augustini ..... A61J 1/2062
10,744,315 B2 * 8/2020 Sanders ..... A61J 1/2089
2006/0074348 A1 * 4/2006 Spray ..... A61B 5/150732 604/408
2020/0093558 A1 * 3/2020 Naygauz ..... A61J 1/1475

FOREIGN PATENT DOCUMENTS

CA 3048520 A1 * 8/2018 ..... A61J 1/2024
EP 0105330 B1 * 4/1988 ..... B65B 43/26

* cited by examiner

*Primary Examiner* — Nicolas A Arnett
(74) *Attorney, Agent, or Firm* — Theodore J. Bielen, Jr.

(57) ABSTRACT

An apparatus and method for aseptically filling a container utilizing an adaptor formed of severable and heat-sealable material connected to a tube and container. The adaptor includes a membrane which is unsealed to allow filling by a known filling machine. Once the adaptor tube and container is formed as a unit, it is sterilized. The adaptor is then severed and sealed, creating a usable aseptic liquid product.

6 Claims, 3 Drawing Sheets

ASEPTIC FILLING APPARATUS AND METHOD

BACKGROUND OF THE INVENTION

Asepsis processing includes methods that are used to promote stability in a product such as a liquid food, pharmaceutical, and the like. Essentially, an aseptic process typically renders such item sterile, and fills and seals the same into a sterile container.

In the past, bags formed of polymeric material have been aseptically filled using the combination of a gland welded to the face of the bag and a pair of membranes. Such a bag creation requires special equipment that is not compatible with current fill equipment.

In addition, a sealed tube has been used attached to a bag followed by the manual cutting of the tube and attaching the same to the supply of sterile solution. A heated cutter blade is employed in this technique. Essentially, this latter method is labor intensive, as bags are individually filled by hand. Also, the aseptic liquid contained in the bag is not accurately ascertained since measurement of the same is derived on a weigh scale. Needless to say, the fill rates using this method are extremely slow.

Reference is made to U.S. Pat. No. 3,101,752 in which an aseptic filling machine is revealed. Current filling machines are similar to that shown in U.S. Pat. No. 3,101,752, but have not been adequately been adapted to filling sterilized bags containing aseptic liquids.

Other prior sterilization and sampling apparatuses have been devised. For example, U.S. Pat. No. 5,234,411 discloses a catheter assembly where one end of a sheath is secured to a hub as a sealed fit to allow a hollow needle to gain access to liquid flow.

U.S. Pat. No. 5,334,188 utilizes an injection needle to provide fluid communication through a close injection site to transport fluid into a tube.

U.S. Pat. No. 4,386,933 shows a sterile entry system for use in transferring blood that includes a sleeve which jackets the exterior of a transfer tube. The tube has seals which are adapted to be pierced.

U.S. Pat. No. 8,777,921 describes a sterile sampling apparatus and method where a closed sterile sight chamber is connected to a pouch to allow fluid to flow into such chamber and, at the same time, permits air to enter the chamber. The pouch is severed after sampling takes place.

U.S. Pat. RE317696 shows a multiple access fluid connector in which a plurality of access ports are provided to transport fluid through a multipart manifold element. The manifold is formed by mating of elements having matchable ports. Selected ports are severable, as desired.

There is a need for simplifying the aseptic filling of bags with liquids utilizing precision filling devices.

SUMMARY OF THE INVENTION

In accordance with the present application, a novel and useful aseptic filling apparatus and method of carrying out such filling is herein provided.

The filling apparatus involves the transporting of an aseptic liquid from a source such as an aseptic filling machine to a container such as a polymeric bag. The filling apparatus includes as one of its elements and adaptor that is formed with a first end portion, a second end portion, and an intermediate portion. The adaptor includes a passageway with an exit at the first end portion and an entrance at the second end portion. The adaptor intermediate portion is constructed of severable and sealable material. The adaptor is further configured to receive an aseptic liquid from a source through the entrance to the passageway. A membrane is fixed to the second end portion of the adaptor and is capable of being unsealed to accept aseptic liquid from the source.

In addition, a tube is employed with the adaptor and includes an opening or aperture that communicates with the passageway of the adaptor at the entrance to the same. The tube is attached using a connector, which may take the form of a cinching band or tie wrap. A container, such as a bag formed of a polymeric material, includes a chamber that is attached to the tube such that the tube opening communicates with the chamber of the container. The tube is connected to the container in a permanent manner.

The first end portion of the adaptor may include at least one flange and is employed to connect the adaptor to the source of aseptic liquid. Likewise, the severable and sealable intermediate portion of the adaptor includes material that is sealable under the influence of heat. Moreover, the first end portion of the adaptor possesses a barbed end compatible with the tube connection.

In addition, a method of transporting an aseptic liquid from a source is herein provided. The method includes the step of using an adaptor having a first end portion, a second end portion, and an intermediate portion with a passageway through the same. Again, the passageway incudes an exit at the first end portion and an entrance at the second end portion of the adaptor. Further, the adaptor intermediate portion is constructed of severable and sealable material.

The method includes a further step of removably fixing a membrane to the second end portion of the adaptor and providing and connecting or attaching the tube to a container to permit communication of an opening through the tube to a container having a chamber.

Further, the first end portion of the adaptor is connected to the tube, while the second end portion of the adaptor is attached to the source of the aseptic liquid.

In addition, a further step is employed in which the membrane attached to the second end portion of the adaptor is unsealed and may be cut or pierced in such a step. Once the membrane is sealed, aseptic liquid is passed from the source to the adaptor passageway, to the tube opening, and to the container. Finally, the intermediate portion of the adaptor is severed and heat sealed.

Additional steps may take place in the sterilization of the adaptor, tube, and container by the use of irradiation and the like.

It may be apparent that a novel and useful apparatus and method of providing a filling apparatus for the transporting of aseptic liquid from a source and a method to carry out the same has been hereinabove described.

It is therefore an object of the present apparatus to provide a filling apparatus for transporting an aseptic liquid from a source which utilizes a novel adaptor which may be employed with precision automatic filling machines.

Another object of the present application is to provide a filling apparatus for transporting an aseptic liquid from a source and a method for carrying out the same which provides aseptically filled containers at a very high rate of speed and accurately measures the quantity of aseptic liquid within the container.

Another object of the present application is to provide a filling apparatus for transporting an aseptic liquid from a source and method to carry out the same in which a single pierceable membrane is used, thus simplifying aseptic filling technology.

Another object of the present application is to provide a filling apparatus for transporting an aseptic liquid from a source and a method for carrying out the same which eliminates hand filling of aseptic containers in a slow and tedious manner.

Another object of the present application is to provide a filling apparatus for transporting an aseptic liquid from a source and a method for carrying out the same which employs known automatic filling machines as a source of the aseptic liquid and known cutting apparatuses for severing and sealing components of the apparatus.

Another object of the present application is to provide a filling apparatus for transporting an aseptic liquid from a source and a method for carrying out the same which is relatively simple and economical in comparison to the prior art devices and methods.

Yet another object of the present application is to provide a filling apparatus for transporting an aseptic liquid from a source that is economical and does not require the investment in expensive manufacturing equipment.

The application possesses other objects and advantages especially as concerns particular characteristics and features thereof, which will become apparent as the specification continues.

For a better understanding of the application reference is made to the following detailed description of the preferred embodiments thereof which should be taken in conjunction with the prior described drawings.

DETAILED DESCRIPTION OF THE PREFERRED EMBODIMENTS

Various aspects of the application will evolve from the following detailed description of the preferred embodiments thereof which should be taken in conjunction with the prior described drawings.

Figure 1:
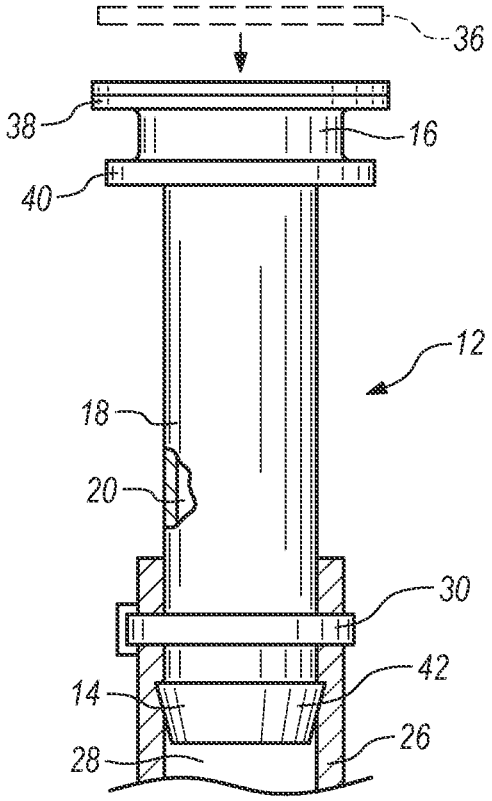
FIG. 1 is a side-elevational view of the adaptor and portions of a connected tube and membrane employed in the present application.
Figure 2:
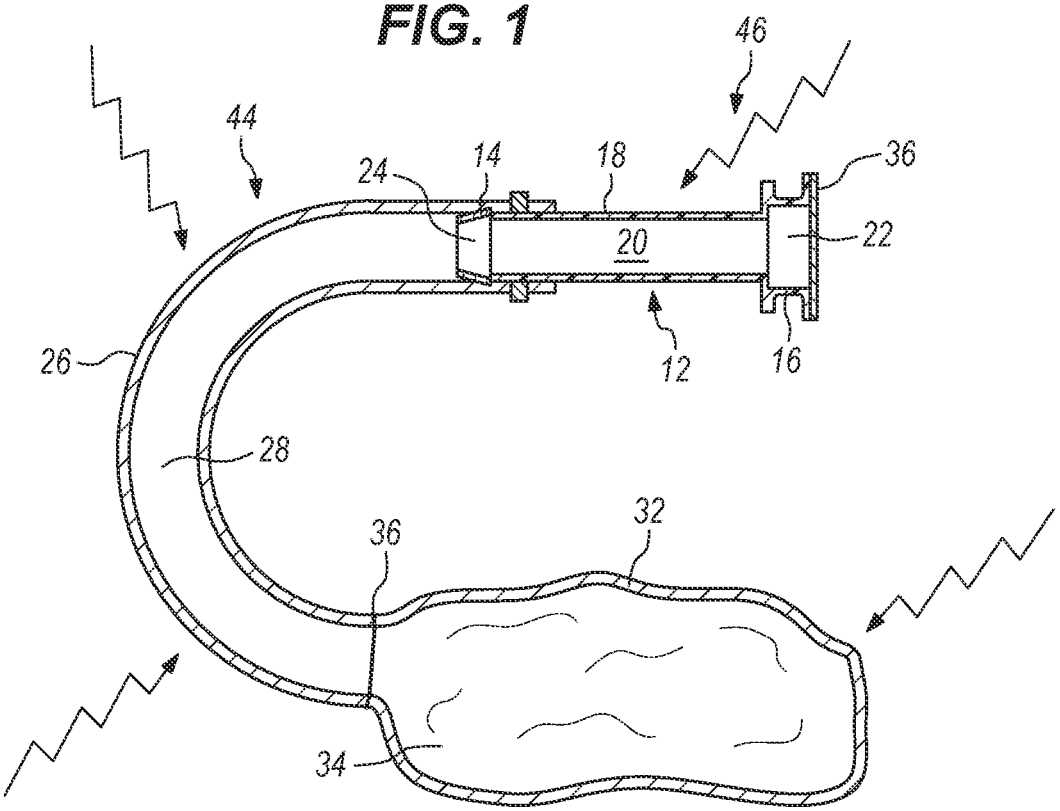
FIG. 2 is a sectional view showing the adaptor of FIG. 1 connected to a tube which is attached to a container to be filled with aseptic liquid.
Figure 5:
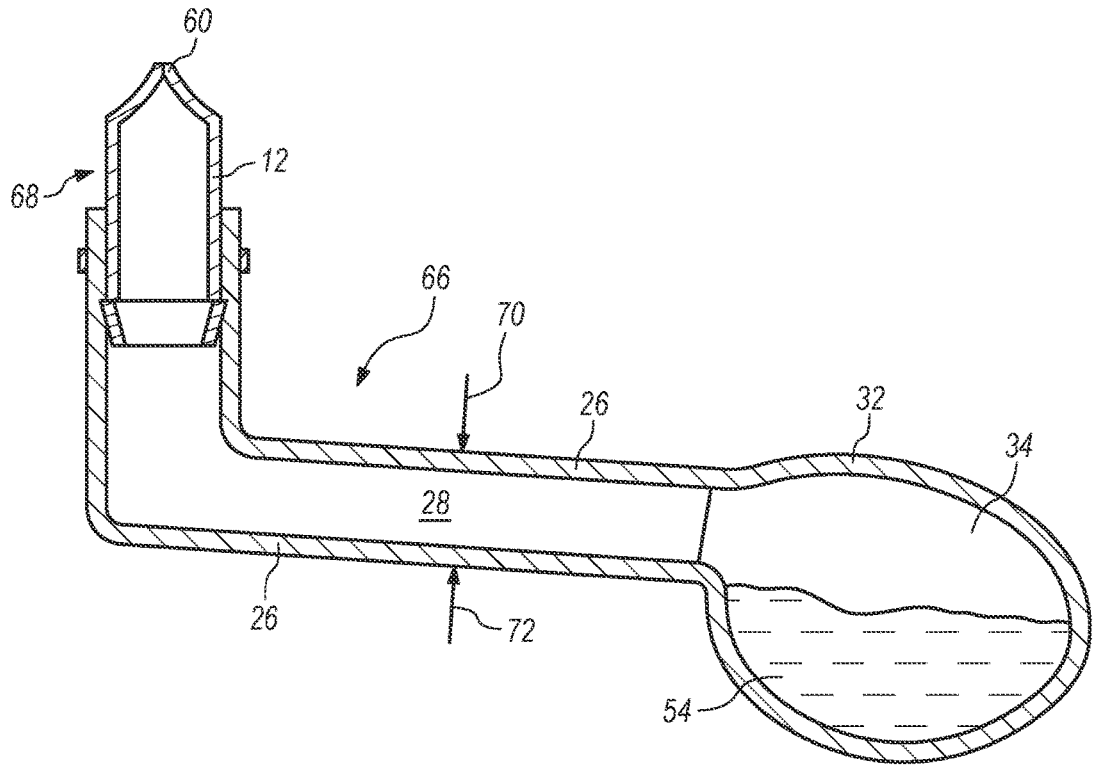
FIG. 5 is a sectional view showing a severed and sealed adaptor, connected to an attached container which has been filled with aseptic liquid.

The apparatus as a whole is depicted in the drawings by reference character 10, as illustrated in FIGS. 2 and 5. With reference to FIG. 1, it may be observed that an adaptor 12 is employed. Adaptor 12 is generally cylindrical in shape and is formed of severable and heat sealable material such as polyethylene. Adaptor 12 is constructed with a first end portion 14, a second end portion 16, and an intermediate portion 18. Further, adaptor 12 includes a passageway 20 through the same. Passageway 20 includes an entrance 22 and an exit 24, best shown in FIG. 2. In essence, aseptic liquid is intended to flow through passageway 20 through entrance 22 and out through exit 24, which will be discussed in further detail as the specification continues.

Again, referring to FIG. 1, it may be observed that a tube 26 is employed in the present apparatus 10. Tube 26, FIGS. 1-3, includes an opening or aperture 28. A connector 30, such as a tie wrap, attaches tube 26 to first end portion 14 of adaptor 12 such that opening 28 of tube 26 communicates with passageway 20 of adaptor 12. Such communication takes place at exit 24 therefrom. Tube 26 leads to a container 32 depicted as a polymeric bag. It also should be noted that container 32 is presented in miniature fashion for the sake of clarity in the drawings. However, bag 32 may be notably larger than that depicted in the drawings. Container 32 includes a chamber 34. Tube 26 is permanently attached to container 32 at attachment place 36, allowing aperture 28 to communicate with chamber 34. A membrane 36 is attached to adaptor 12 at second end portion 16 by any suitable means such as gluing, welding, and the like. Membrane 36 may be cut or pierced at a later time, as will be described hereinafter. It should also be noted that adaptor 12 includes flanges 38 and 40 at second end portion 16 to permit attachment of the same to a known filling apparatus which serves as the source of aseptic liquid. In addition, first end portion 14 is manufactured with a barbed end configuration 42 which is compatible with tube 26 and connector 30.

As shown in FIG. 2, the adaptor 12, tube 26, and container 32 are initially formed into a unit 44 that is sterilized by any suitable means. FIG. 2 indicates an irradiation method of sterilization shown by plurality of jagged-lined arrows 46.

Once sterilized, unit 44 may be employed to carry aseptic liquid from a source 46, dashed lines on FIG. 1, of conventional configuration. For example, source 46 may take the form of a modified filling machine known as the ENGI-O A3.

Figure 3:
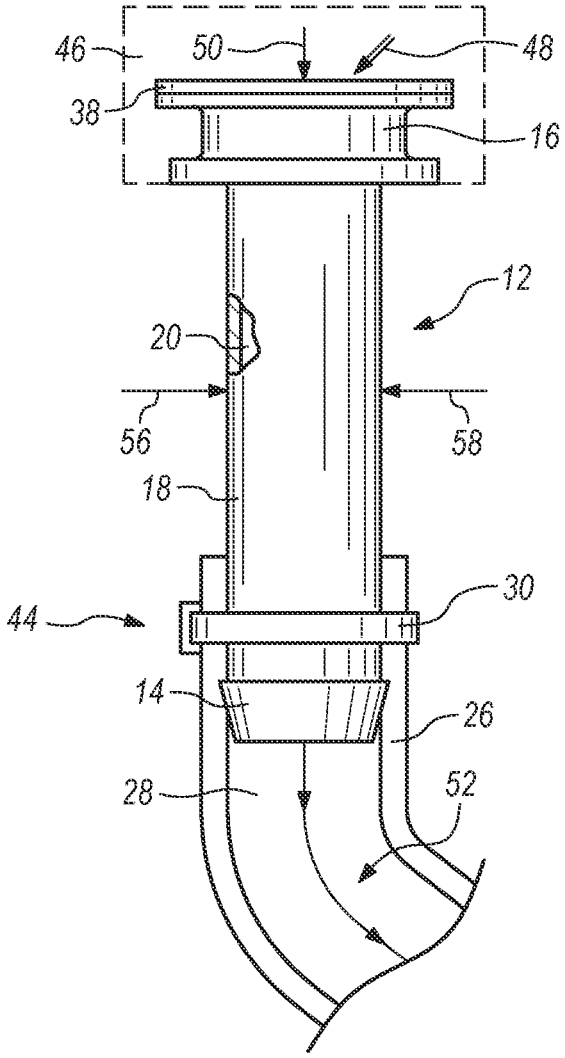
FIG. 3 is a side-elevational view of the adaptor of the present apparatus with indications of the membrane piercing, severing of the adaptor, and passage of aseptic liquid through the connected tube.

Referring now to FIG. 3, the employment of unit 44 and the method of aseptic filling of the present application is shown. Directional arrow 48 represents the piercing or unsealing of membrane 38 by filling machine 46, a known process associated with filling machine 46. Directional arrow 50 shows the passage of aseptic liquid from automatic filling machine 46 into entrance 16 of adaptor 12. Directional arrow 52 traces the passage of aseptic liquid through tube 26 via aperture 28 and into container 34 (not shown).

Figure 4:
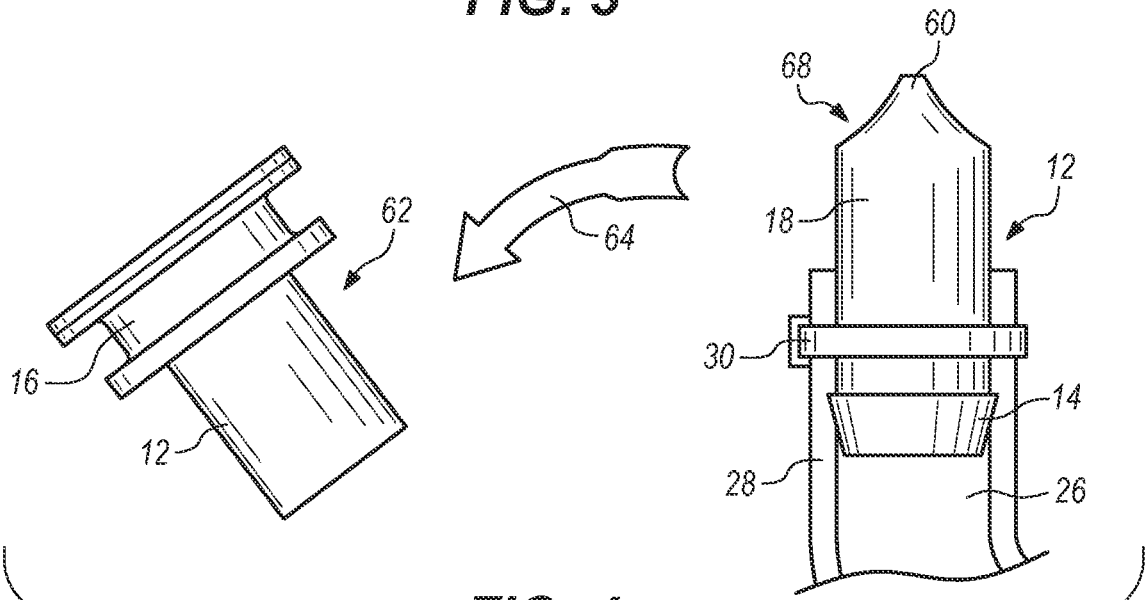
FIG. 4 is a side-elevational view of a severed and sealed adaptor as well as an indication of discarded portions of the same.

Once container 32 is filled with aseptic liquid 54, FIG. 5, adaptor 12 is severed and sealed at intermediate portion 18, directional arrows 56 and 58 of FIG. 3. Such process is achieved by the use of an impulse sealer, known in the art. It also should be noted that bag 32 filled with aseptic liquid 54 is measured using an accurate flow meter in conjunction with filling machine 46. The severing and sealing of intermediate portion 18 of adaptor 12 leaves a narrowed terminus 60 of the now shortened adaptor 12. The severed part 62 of adaptor 12, FIG. 4, is then discarded as indicated by arrow 64.

Viewing now FIG. 5, it may be apparent that an aseptically filled and sealed unit 66 has been created utilizing the severed and sealed portion 68 of adaptor 12, tube 26, and connected container 32 filled with aseptic liquid 54. Unit 66 is then passed to a user. A user would then cut or open tube 26 indicated by directional arrows 70 and 72 and discard portion 74 which includes part 68 of adaptor 12 and a portion 76 of tube 26. Aseptic liquid 54 within chamber 43 of container 34 may then be employed by the user.

Figure 6:
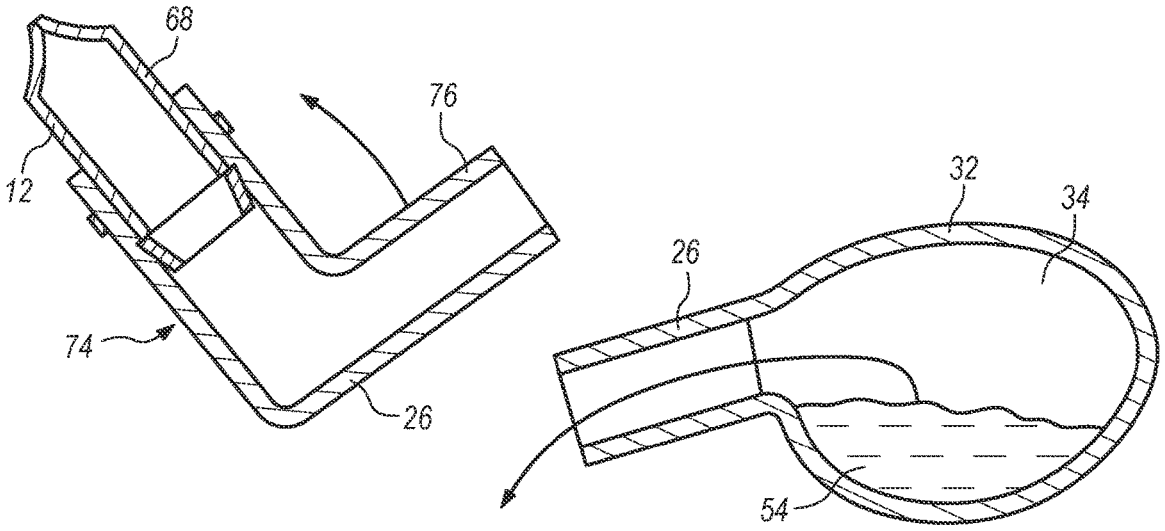
FIG. 6 is a sectional view showing the severing of the tube connected to the container for use by a user and the discarding of unwanted components.

In operation, the apparatus 10 of the present application is assembled utilizing adaptor 12, FIG. 1, which is attached to a tube 26 via a connector 30. Tube 26 is, in turn, fixed permanently to a polymeric bag 32 to form a unit 44. Unit 44 is then sterilized using known methods such as irradiation. Following sterilization of unit 44, membrane 38 of adaptor 12 is unsealed or pierced, allowing aseptic liquid to flow from a prior art conventional filling machine 46, through passageway 20 of adaptor 12, passageway 28 of tube 26, and into chamber 34 of container 32. It should be noted that filling machine 46 is also capable of such piercing or unsealing membrane 38 at second end portion 16 of adaptor 12, in this regard. Once aseptic liquid 54 flows to container 32, adaptor 12 is severed and sealed at intermediate portion 18, according to directional indicator arrows 56 and 58. A narrow terminus 60 is formed on remaining part 68 of adaptor 12 and serves as part of a unit 66 which is then transported to a user. The severed part 62 of adaptor 12 is discarded. Once the user receives unit 66, tube 26 is cut, arrows 70, 72, FIG. 5, allowing aseptic liquid 54 to flow from chamber 34 of container 32 for use. The severed portion 74 of unit 66 is then discarded. It should be realized that once unit 44 has been assembled and sterilized, aseptic fluid 54 is allowed to pass to chamber 34 of container 32. Sterilization is maintained until the user severs tube 26 and gains access to aseptic fluid 54, FIG. 6.

While in the foregoing, embodiments of the application have been set forth in considerable detail for the purpose of making a complete disclosure of the invention, it may be apparent to those of skill in the art that numerous changes may be made in such details without departing from the spirit and principles of the invention.

What is claimed is:

1. A method of transporting an aseptic liquid from a source, comprising the steps of:

providing an adaptor comprising a first end portion, a second end portion, and an intermediate portion, said adaptor further comprising a passageway therethrough, said passageway further comprising an exit from said passageway at said first end portion and an entrance to said passageway at said second end portion, said adaptor intermediate portion being constructed of severable and sealable material;

removably fixing a membrane to said second end portion of said adaptor;

providing a tube having an opening therethrough;

providing a container possessing a chamber;

attaching said tube to said container to permit communication of said opening through said tube with said chamber of said container;

attaching said first end portion of said container to said tube to permit communication of said exit of said adaptor to said opening through said tube;

attaching said second end portion of said adaptor to the source of aseptic liquid;

unsealing said membrane from said second end portion of said adaptor;

passing aseptic liquid from the source to said adaptor passageway, to said tube opening, and to said container;

severing and sealing said intermediate portion of said adaptor.

2. The method of claim 1 which additionally comprises the step of sterilizing said adaptor, said tube, and said container prior to said step of attaching said second end portion of said adaptor to the source of aseptic liquid.

3. The method of claim 2 in which said step of sterilizing said adaptor, said tube, and said container comprises sterilizing by the use of irradiation.

4. The method of claim 1 which additionally comprises the step of severing and sealing said tube.

5. The method of claim 4 which additionally comprises the step of sterilizing said adaptor, said tube, and said container prior to said step of attaching said second end portion of said adaptor to the source of aseptic liquid.

6. The method of claim 5 in which said step of sterilizing said adaptor, said tube, and said container comprises sterilizing by the use of irradiation.

* * * * *